US007523750B2

(12) United States Patent
Krzysztofik

(10) Patent No.: US 7,523,750 B2
(45) Date of Patent: Apr. 28, 2009

(54) BREATHING RESPIRATOR

(76) Inventor: J. Mario Krzysztofik, 9555 Fern Hollow Way, Montgomery Village, MD (US) 20886

( * ) Notice: Subject to any disclaimer, the term of this patent is extended or adjusted under 35 U.S.C. 154(b) by 422 days.

(21) Appl. No.: 10/986,209

(22) Filed: Nov. 12, 2004

(65) Prior Publication Data

US 2005/0241642 A1 Nov. 3, 2005

Related U.S. Application Data

(60) Provisional application No. 60/518,628, filed on Nov. 12, 2003.

(51) Int. Cl.

| | |
|---|---|
| ***A62B 7/10*** | (2006.01) |
| ***A62B 19/00*** | (2006.01) |
| ***A62B 23/02*** | (2006.01) |
| ***A62B 18/10*** | (2006.01) |

(52) U.S. Cl. ..... 128/201.25; 128/201.28

(58) Field of Classification Search ..... 128/200.27, 128/201.12, 201.17, 201.19, 201.22, 201.24–25, 128/201.28, 206.12–13, 206.15–18, 206.21, 128/206.23, 207.11

See application file for complete search history.

(56) References Cited

U.S. PATENT DOCUMENTS

| | | | | |
|---|---|---|---|---|
| 2,376,871 | A * | 5/1945 | Fink | 128/201.19 |
| 2,811,967 | A * | 11/1957 | Stampe | 128/206.15 |
| 2,868,196 | A * | 1/1959 | Stampe | 128/206.15 |
| 3,822,698 | A * | 7/1974 | Guy | 128/201.25 |
| 4,674,136 | A * | 6/1987 | Ladewig | 2/428 |
| 4,881,538 | A | 11/1989 | Angell | |
| 5,226,411 | A | 7/1993 | Levine | |
| H1316 | H | 6/1994 | McGuiness | |
| 5,553,606 | A | 9/1996 | Chen | |
| 5,555,569 | A * | 9/1996 | Lane | 2/424 |
| 5,669,375 | A * | 9/1997 | Dahrendorf et al. | 128/206.17 |
| 5,697,363 | A | 12/1997 | Hart | |
| 5,771,886 | A * | 6/1998 | Maire et al. | 128/207.11 |
| 6,119,689 | A | 9/2000 | Korman | |
| 6,121,881 | A | 9/2000 | Bieback et al. | |
| 6,176,239 | B1 | 1/2001 | Grove et al. | |
| 6,381,369 | B1 | 11/2001 | Gregory | |
| 6,382,206 | B1 | 5/2002 | Palazzotto et al. | |
| 6,382,208 | B2 | 5/2002 | Reedy et al. | |
| 6,386,198 | B1 | 5/2002 | Rugless | |
| 6,401,716 | B1 * | 6/2002 | Sword et al. | 128/206.21 |
| 6,427,694 | B1 | 8/2002 | Hecket et al. | |
| 6,886,559 | B2 * | 5/2005 | McDonald et al. | 128/201.24 |
| 7,117,868 | B1 * | 10/2006 | Japuntich et al. | 128/205.27 |
| 2001/0050079 | A1 | 12/2001 | Piesinger | |
| 2002/0153192 | A1 | 10/2002 | Falco et al. | |

* cited by examiner

*Primary Examiner*—Steven O Douglas
*Assistant Examiner*—Kristen C Matter
(74) *Attorney, Agent, or Firm*—Richard C. Litman

(57) ABSTRACT

The combination noise suppression and breathing respirator of the present invention includes a face mask of the snorkel or diving type, the facemask sealing against the face of the user around the nose, cheeks, eyes and forehead of the wearer. The facemask has a nosepiece having an exhalation flap check valve for exhalation by the user. Each side of the face mask has a one-way inlet valve at a connection which connects with rearward extending dual use air channel and straps. A noise suppression and air filter module is worn over each ear of the user and is attached to respective dual use air channel and straps. Head bands extend around the back of the wearer's head between air filter modules an adjustably connected by buckles thereto.

3 Claims, 5 Drawing Sheets

BREATHING RESPIRATOR

CROSS-REFERENCE TO RELATED APPLICATION

This application claims the benefit of U.S. provisional Patent Application Ser. No. 60/518,628 filed Nov. 12, 2003.

BACKGROUND OF THE INVENTION

1. Field of the Invention

The present invention relates to filtered breathing respirators. The present device permits normal breathing while providing for constant air renewal which creates an efficient defogging action for the faceplate lens. Inhalation and exhalation is through one-way check valves that ensure constant flow in one direction without backflow.

2. Description of the Related Art

The breathing masks of the related art are conventionally categorized as full facepiece respirators which are designed to cover the entire face of the wearer or half mask respirators which are designed to cover the nose and mouth of the wearer. Each of these types of respirators has their own type of valves and filters for breathing while the wearer is in a hazardous environment.

SUMMARY OF THE INVENTION

The breathing respirator of the present invention relocates the filter elements from the front of the mouthpiece, to either behind the head or integrated with noise reduction ear muffs, thereby allowing for a sleeker, smaller, light-weight supporting facepiece free of obstructing elements in front of the face.

Also, the breathing respirator leaves the mouth free of constraints of the conventional full face respirator or the half mask respirator. Unlike the latter two types, the disclosed breathing respirator allows unimpeded speech in a normal way without the need of electronically assisted communication capabilities. This feature allows the wearer to have a normal conversation with others without removing the facepiece or respirator.

Further, the respirator of the instant invention permits circulation of air created within the facepiece, through normal breathing through the nose. This feature keeps the facepiece lens free of mist and fogging at all outside temperatures. Many existing respirators resort to adding gadgets to the respirator, such as battery-driven fans, to reduce the fogging.

Additionally, by relocating the filter elements to the ears or back of the head, a wider filtering area can be obtained. This allows a thinner, yet still efficient, filter that can be worn under a hard hat, helmet, etc.

Also, since the use of a breathing respirator and eye protector go hand-in-hand, a device that envelops both the eyes and nose is beneficial. This feature is paramount whenever multiple safety devices, such as safety goggles, noise reduction ear muffs, respirator, hard hat, are required. Since these are built in a single-purpose unit, the simultaneous wearing of two or more is almost impossible, or at least extremely uncomfortable and cumbersome.

The described breathing respirator incorporates eye protection, safe breathing, and noise reduction all in one comfortable, sleek unit, which can still be worn under additional equipment, such as a hard hat.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises embodiments of a breathing respirator. The breathing respirator is intended to be used in a variety of hazardous environments, such as smoke, noxious fumes, dust, and pollutants. The breathing respirator has an eye/nose plenum facepiece that permits a wearer to breathe through the nose. Filters may be integrated with noise reduction ear muffs or may be located at the back of the wearer's head. The breathing respirator is further intended in keeping the facepiece fog and mist free due to the normal breathing through the nose and the circulation of ambient air.

Figure 1:
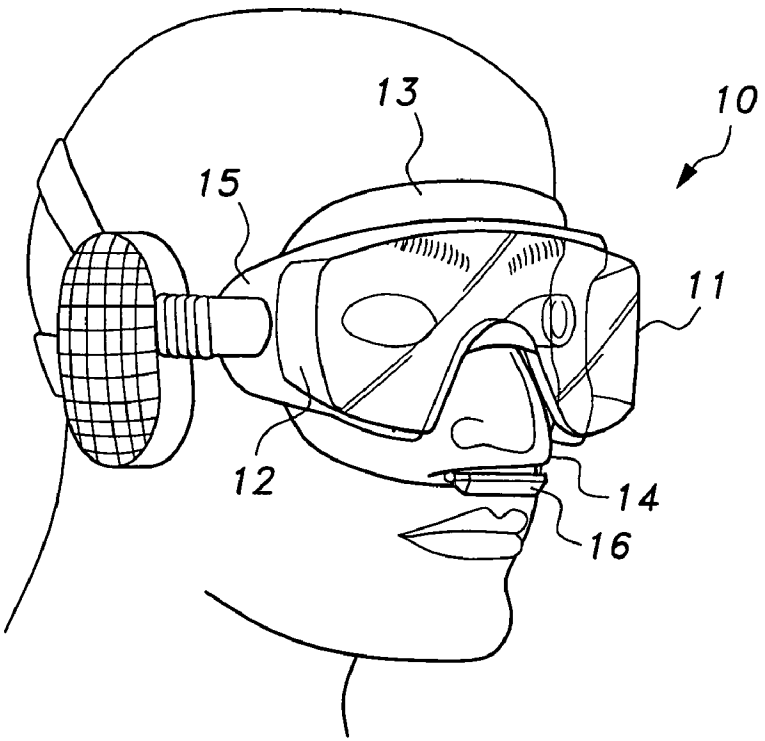
FIG. 1 is an environmental, perspective view of a first embodiment of the breathing respirator on the head of a wearer according to the present invention.
Figure 3:
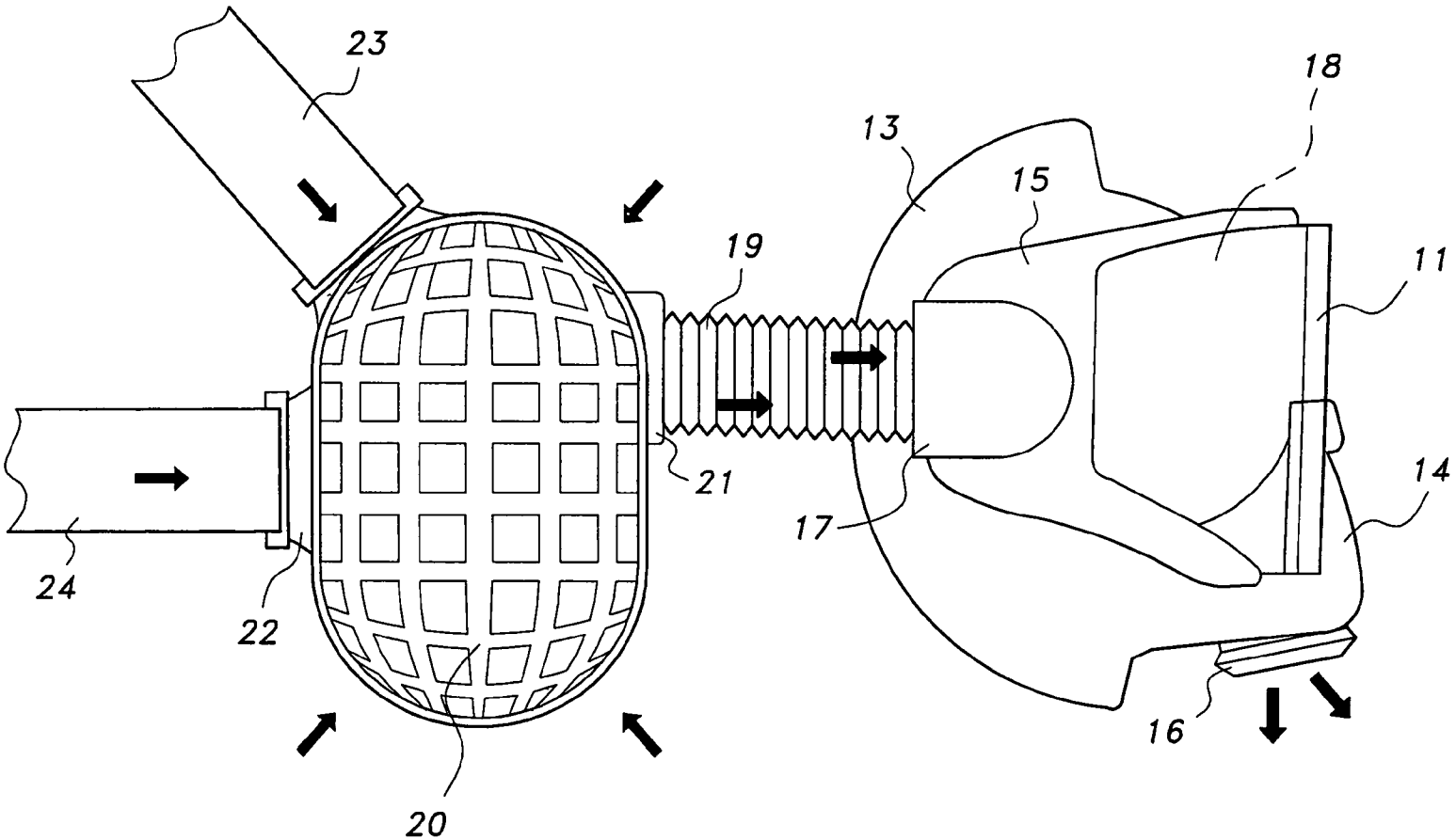
FIG. 3 is a side view of the first embodiment.
Figure 4:
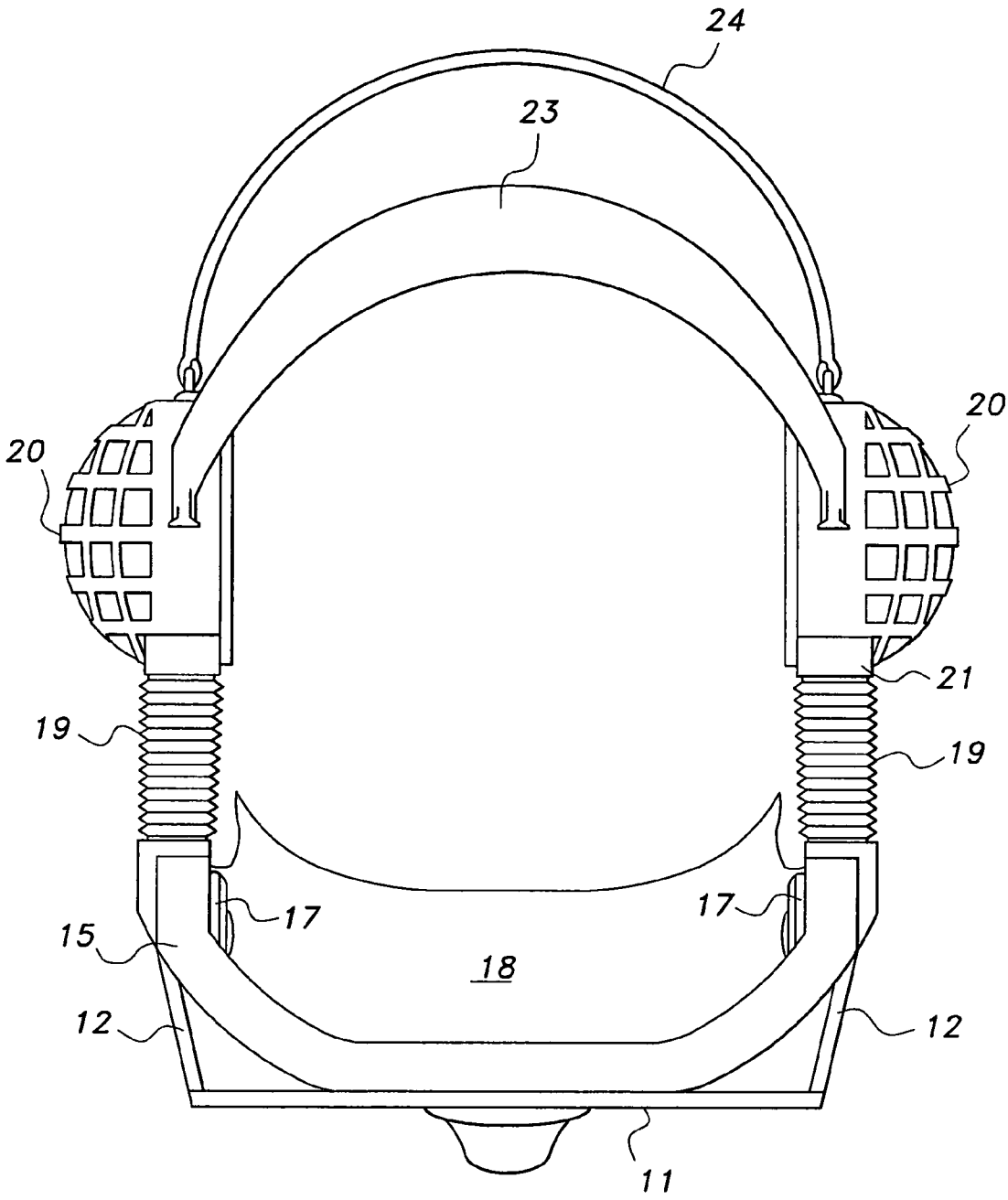
FIG. 4 is a top view of the first embodiment.

FIGS. 1, 3, and 4 illustrate a first embodiment of the breathing respirator. Air flow is indicated by the illustrated arrows. FIGS. 1, 3, and 4 depict the combination of a breathing respirator possessing filters integrated with noise reduction ear muffs. The figures depict a face mask 10 having a front lens 11 having a side lens 12 on each side thereof. A face conforming sealing body 13 has a nose conforming portion 14 and a frame 15 supporting the lenses and the sealing body. An exhalation one-way check valve 16 is located on the nose portion, while an inhalation one-way check valve module (shown generally at 17) is located in each of the side portions of the frame. The face mask defines a plenum chamber 18 between the front lens 11 and the face of the wearer.

A dual purpose air channel and face mask strap 19 is connected with the side frame portions and extend rearward therefrom. The air channels 19 are in one-way fluid communication with the plenum chamber 18 through the check valve modules 17.

A pair of integrated air filters and noise reduction modules 20 is each provided with a sealing frame for placement over the respective ears of the wearer. An air inlet grid 21 extends outward from the sealing frame and is in fluid communication with the air channel 19. Each sealing frame 20 is provided with rearward mounted buckles 22 to receive head mounting straps 23 and 24.

Thus, air for breathing through the wearer's nose travels first through the filters 20, then through the air channel 19 and appropriately regulated by one-way check valve 17 and finally into the face mask plenum chamber 18. The exhausted breath exits the chamber 18 through the one-way check valve 16 mounted in the nose portion 14 of the face mask.

Figure 2:
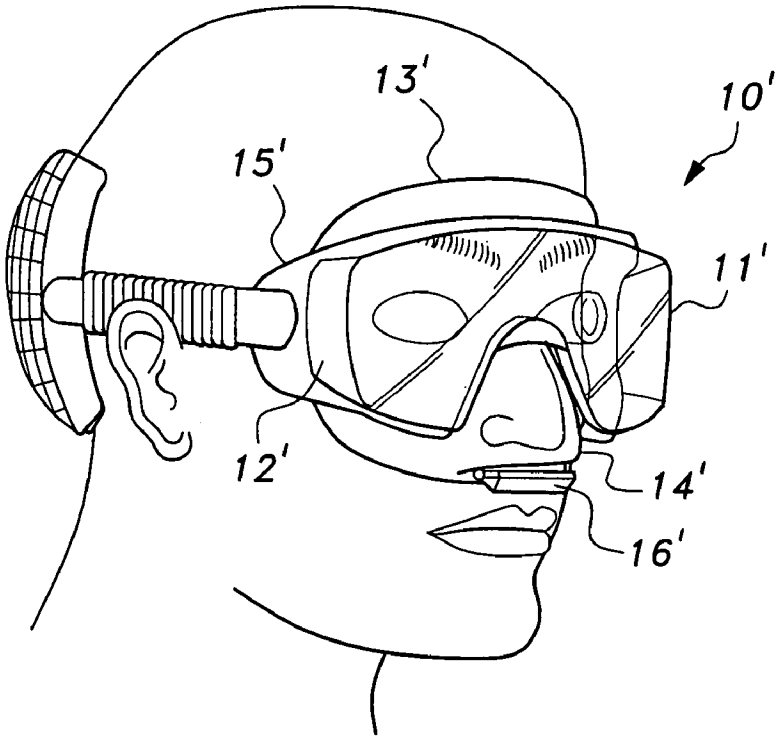
FIG. 2 is an environmental, perspective view of a second embodiment of the breathing respirator on the head of a wearer according to the present invention.
Figure 5:
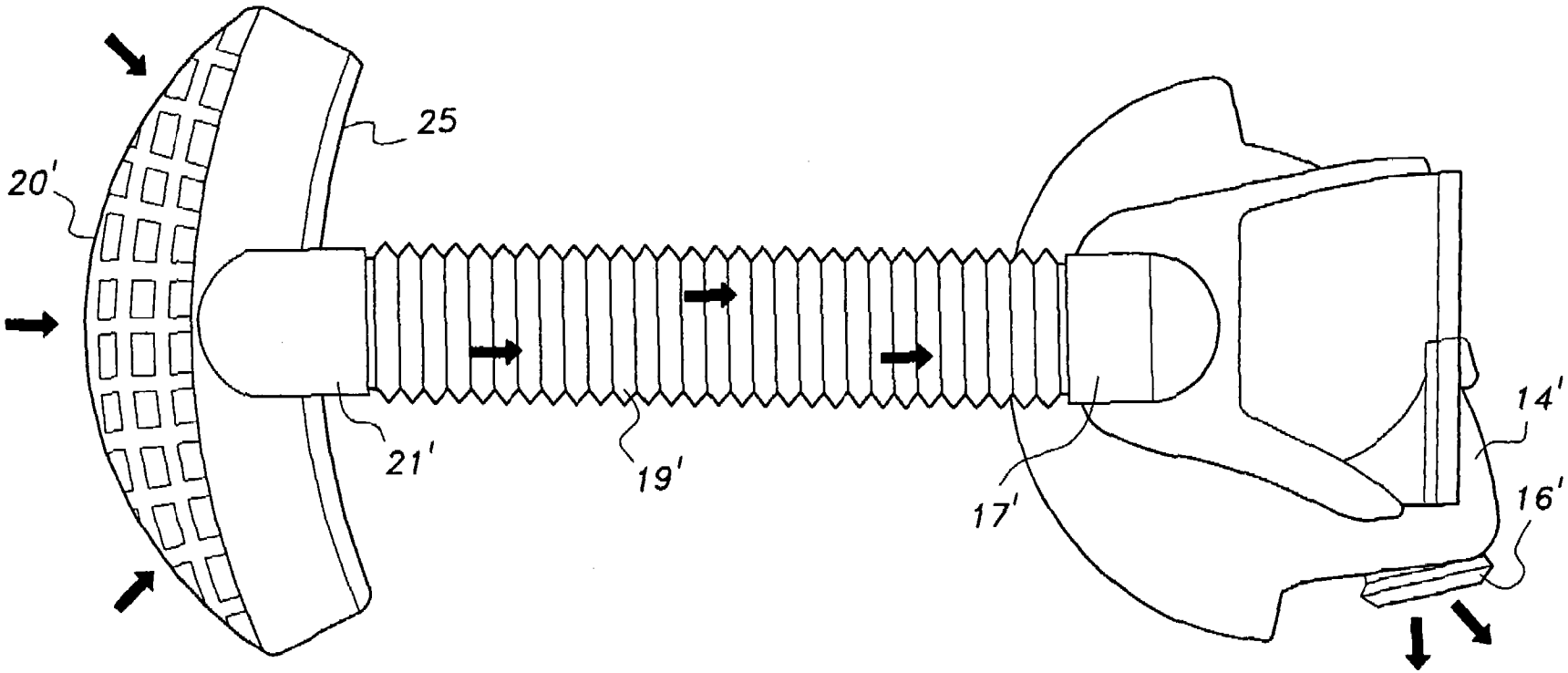
FIG. 5 is a side view of the second embodiment.
Figure 6:
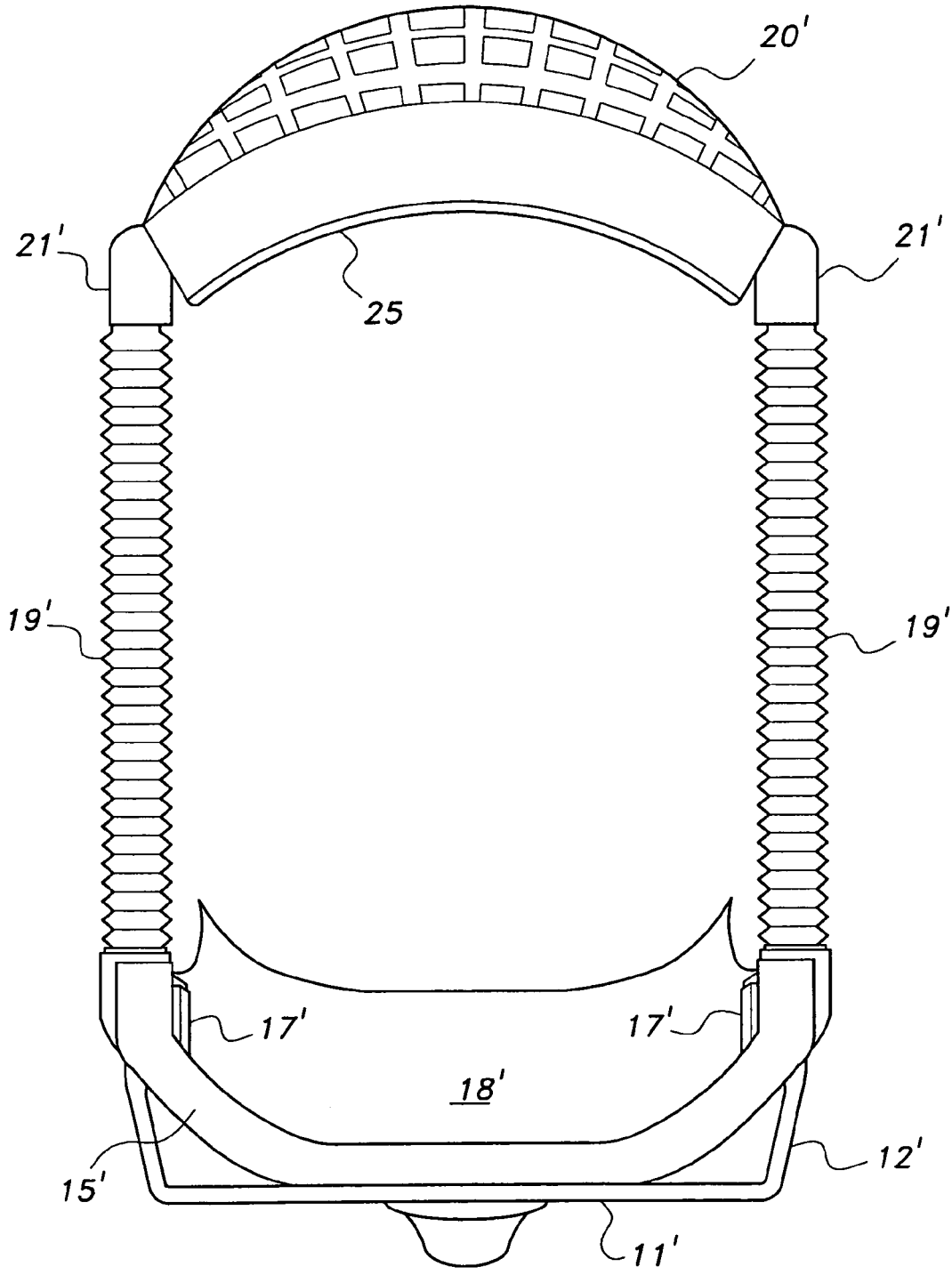
FIG. 6 is a top view of the second embodiment.

Referring to FIGS. 2, 5, and 6, a second embodiment is illustrated. Air flow is again depicted by the arrows. All elements in these figures which are like or similar to the elements in FIGS. 1, 3, and 4 are identified by primed like reference numbers. In this embodiment, the multi-layered filter module 20' is located behind the head and is connected to the wearer and the face mask plenum chamber 18' by plenum air channel 19'. The second embodiment otherwise functions in a similar fashion to the first embodiment.

It is to be understood that the present invention is not limited to the embodiments described above, but encompasses any and all embodiments within the scope of the following claims.

I claim:

1. A combination hearing protector and breathing respirator, comprising:

a one-piece face mask having a front lens having a side lens on each side thereof, a face conforming sealing body having a nose conforming portion, wherein the sealing body and nose conforming portion define an outer peripheral surface of the mask and are adapted to terminate directly below the nose of the wearer thereby leaving the mouth free of constraints, a frame, said frame including frame side portions supporting said lenses and said sealing body, an exhalation one-way check valve located on said nose conforming portion, and a one-way check valve module located in each of said frame side portions; said face mask defining a plenum chamber between said face mask and the face of the user;

a dual purpose air channel and facemask strap connected with each of said frame side portions and extending rearward therefrom, each said air channel being in one-way fluid communication with said plenum chamber through said one-way check valve modules;

a pair of air filter and noise reduction modules each having a sealing frame for sealing over the respective ears of the user, an air inlet grid extending outward from said sealing frame, said sealing frame having outlet air channel connections connected with said rearward extending dual purpose air channel and facemask straps, said air inlet grid being in fluid communication through said outlet air channels and thus said dual purpose air channel and facemask straps; said sealing frame having rearward mounted buckles; and a head band extending between said sealing frame buckles for extending around the back of the user's head, whereby air for breathing through the user's nose travels through said air filter and noise suppression modules, said dual purpose air channel and facemask straps, said one-way check valves, and into said plenum chamber upon breathing in by the user, and exhausted breath exits said plenum chamber through said nose portion mounted exhalation one-way check valve upon exhalation by the user.

2. The combination hearing protector and breathing respirator according to claim 1, wherein each of said noise suppression filter modules has a layered paper filtration medium.

3. A breathing respirator, comprising:

a one-piece face mask having a front lens having a side lens on each side thereof, a face conforming sealing body having a nose conforming portion, wherein the sealing body and nose conforming portion define an outer peripheral surface of the mask and are adapted to terminate directly below the nose of the wearer thereby leaving the mouth free of constraints, a frame, said frame including side portions supporting said lenses and said sealing body, an exhalation one-way check valve located on said nose conforming portion, and a one-way check valve module located in each of said frame side portions; said face mask defining a plenum chamber between said face mask and the face of the user;

a dual purpose air channel and facemask strap connected with each of said frame side portions and extending rearward therefrom, each said air channel being in one-way fluid communication with said plenum chamber through said one-way check valve modules; and an air filter module having a sealing frame for sealing and resting against the back of the user's head, an air inlet grid extending outward from said sealing frame, said sealing frame having outlet air channel connections connected with said rearward extending dual purpose air channel and facemask straps, said air inlet grid being in fluid communication through said outlet air channels and thus said dual purpose air channel and facemask straps; said sealing frame having rearward mounted buckles, whereby air for breathing through the user's nose travels through said air filter and noise suppression modules, said dual purpose air channel and facemask straps, said one-way check valves, and into said plenum chamber upon breathing in by the user, and exhausted breath exits said plenum chamber through said nose portion mounted exhalation one-way check valve upon exhalation by the user.

* * * * *